United States Patent [19]

Murray

[11] Patent Number: 4,766,632

[45] Date of Patent: Aug. 30, 1988

[54] EXPANDABLE MOP FRAME

[75] Inventor: John H. Murray, LaGrange, Ga.

[73] Assignee: Milliken Research Corporation, Spartanburg, S.C.

[21] Appl. No.: 29,528

[22] Filed: Mar. 23, 1987

[51] Int. Cl.[4] ..... A47L 13/258; A47L 13/254

[52] U.S. Cl. ..... 15/147 R; 15/144 R; 15/147 A; 15/147 B; 15/228; 15/229.6; 15/231

[58] Field of Search ..... 15/147 R, 147 A, 147 B, 15/148, 149, 228, 229.1, 229.2, 229.3, 229.4, 229.6, 229.7, 229.8, 144 R, 145, 231

[56] References Cited

U.S. PATENT DOCUMENTS

| | | | |
|---|---|---|---|
| 2,903,730 | 9/1959 | Murphy | 15/299.8 |
| 3,737,938 | 6/1973 | Saltzstein | 15/231 |
| 3,843,993 | 10/1974 | Leland | 15/231 |
| 4,070,726 | 1/1978 | Joffre | 15/228 |
| 4,225,998 | 10/1980 | Thielen | 15/231 |
| 4,656,686 | 4/1987 | Moss et al. | 15/147 A |

*Primary Examiner*—Edward L. Roberts

*Attorney, Agent, or Firm*—H. William Petry; Earle R. Marden

[57] ABSTRACT

An Adjustable mop frame to which predetermined multiples of length can be added to provide wider dust mops and the dust mop handle will always be centrally located on the mop for the convenience of the user. The basic mop frame has a connection on both ends for attachment to extensions thereto and a centered and off-centered handle attachment bar.

7 Claims, 2 Drawing Sheets

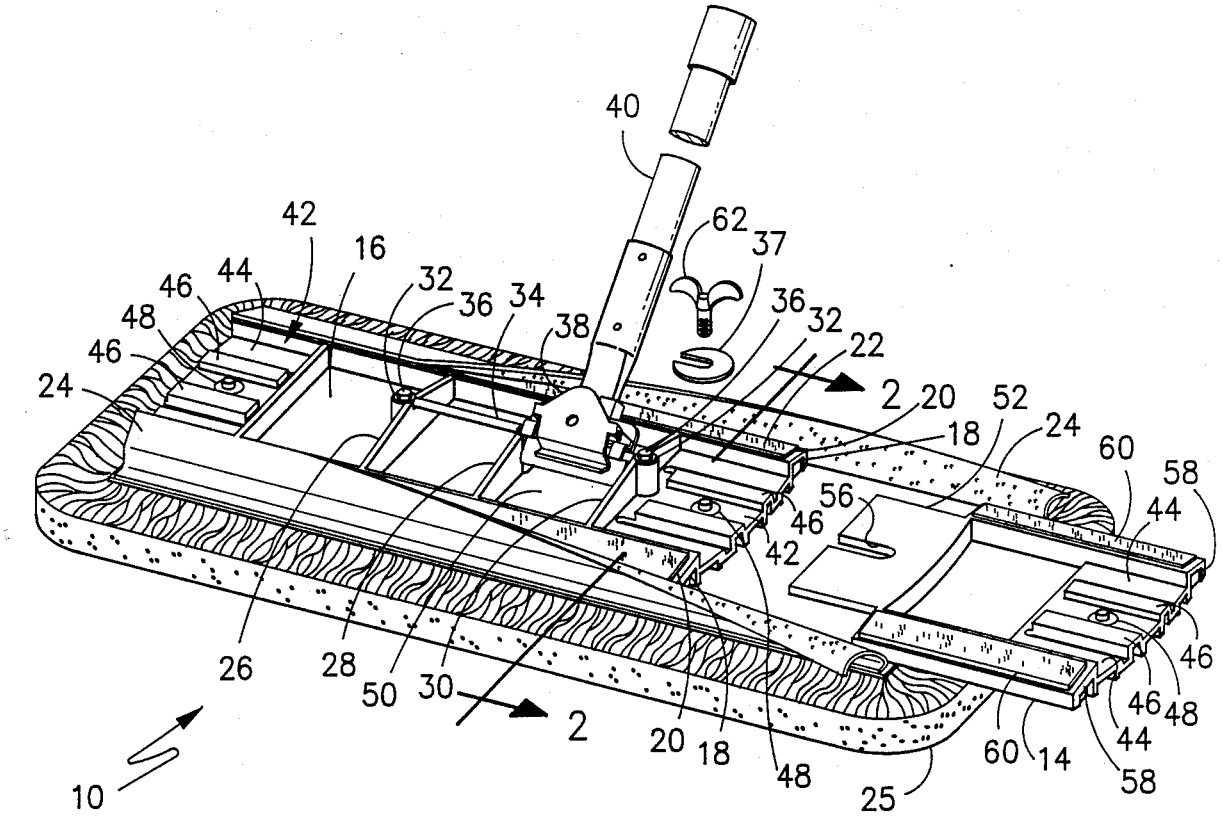
FIG. —1—
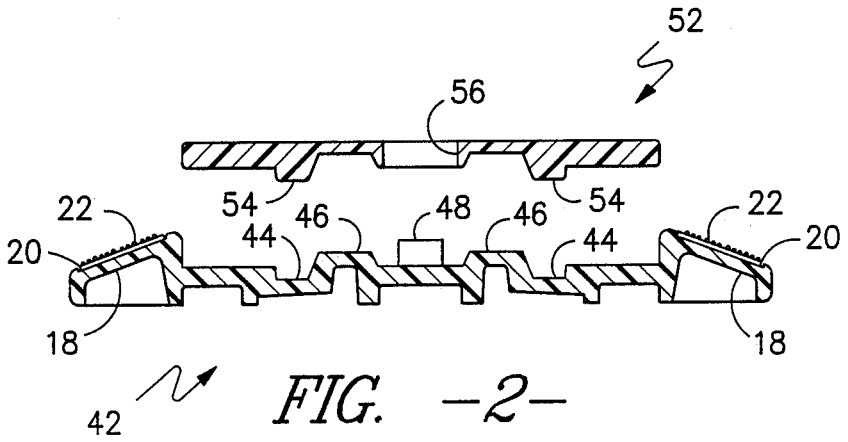
FIG. —2—

EXPANDABLE MOP FRAME

This invention relates generally to an expandable mop frame for a dust mop of the type in which the mop head is easily and readily removed.

An object of the invention is to provide an expandable mop frame which allows the addition of segments to the frame to provide a wider mop surface and the mop handle will always be centrally located for ease of use of the mop.

Other objects and advantages of the invention will become clearly apparent as the specification proceeds to describe the invention with reference to the accompanying drawings, in which:

FIG. 1 is a perspective view of a dust mop like that represented schematically in FIG. 4;

FIG. 2 is a cross-section view on line 2—2 of FIG. 1 as if the mop frame extension is in place, and FIGS. 3–10 schematically represent various mop frame widths available from the basic mop frame.

Currently, commercial users of dust mops (industrial laundries, building service maintenance companies, etc.) use many different lengths of dust mops depending on the particular job. The majority of these mops fall in the range of 18" in width to 48" in width. This requires the user to stock all of the different desired mop frame widths. To alleviate the above inventory problem, the invention described herein provides a basic 18" wide mop frame to which additional segments can be provided to increase the width of the mop frame from 18" wide to 48" wide. In the preferred form of the invention the added segments come in widths of 6", 9" or 12".

Figure 3:
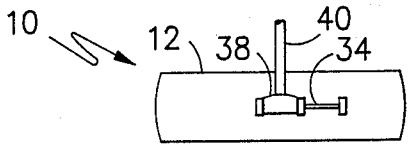
Figure 4:
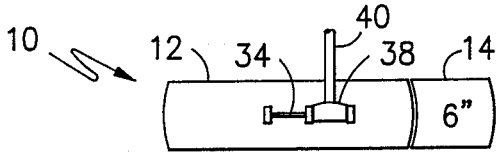
Figure 5:
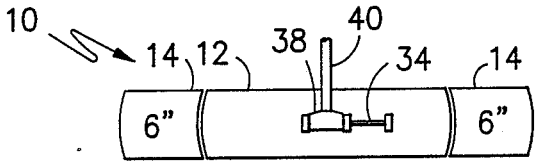
Figure 6:
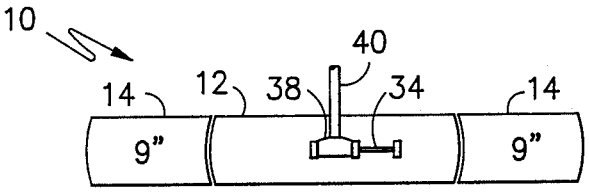
Figure 7:
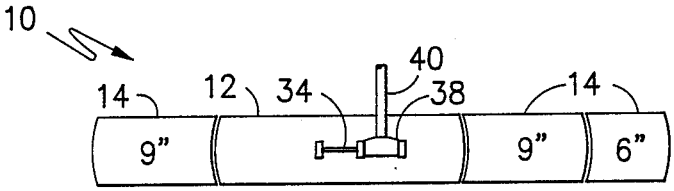
Figure 8:
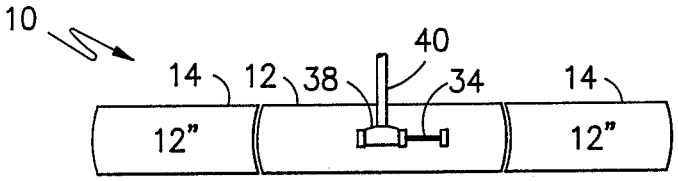
Figure 9:
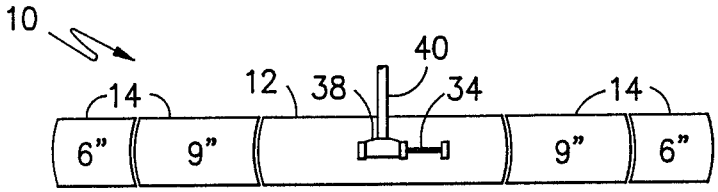
Figure 10:
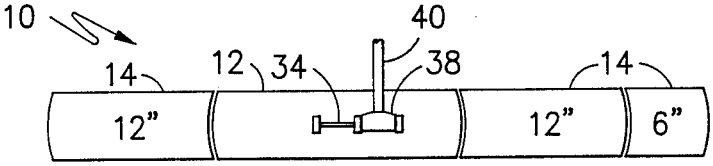

Looking now to FIGS. 1 and 2, the dust mop 10 is shown with the basic frame 12 extended by the addition of a 6" extension 14 to provide the mop represented in FIG. 4. The basic mop frame 12 consists of a substantially flat, rectangular base member 16 of plastic, metal or other suitable material having a pair of upstanding flange members 18, either integral or separate from the base member, to support the strips 20 thereon. The strips 20 have upstanding hook members 22 thereon to engage loops on the underside of the elongated strips 24 sewn or otherwise secured to the mop head 25. The strip or fastening member 22 can be of any suitable type such as that discussed in U.S. Pat. No. 3,000,235 and sold under the trademark VELCRO so long as it has the upstanding hook members 22 for engagement by the loops of the elongated strips 24.

Mounted between and preferably molded to the flange members 18 are partition members 26, 28 and 30. Integrally connected to the outside of the partitions 26 and 30 are internally threaded projections 32. Extending between and located in notches in the top of partitions 26, 28 and 30 is a rod 34 held in position by screws 36 screwed into projections 32 and holding washers 37 against the rod 34. The midpoint between the partitions 26 and 28 is at the center line of the basic mop frame 12 while the midpoint between the partitions 28 and 30 is offset a predetermined distance from the midpoint of the partitions 26 and 28 which in the preferred embodiment is 3". The rod portions between the partitions 26 and 28 and 28 and 30 are adapted to be engaged by the clamping member 38 of the mop handle 40. The clamping member 38 and the mop handle 40 is generally of the type disclosed in U.S. Pat. No. 3,029,454 and is not, per se, part of the invention.

Molded or otherwise secured to the basic mop frame 10 and to each of the extensions 14 are connecting sections 42 which have grooves 44 therein, projections 46 thereon and an internally threaded screw receptor 48 centrally thereof. As shown in FIG. 1 the base frame 16 has two connecting sections 42 while the extensions 14 have only one. The base frame 16 has one connecting section next adjacent the space 50 between partitions 28 and 30 and the other connecting section on the other side of the space 50 on the end of the base frame member 16.

The extensions 14 are molded from a suitable material which is compatible with the base frame 16 and has the aforementioned connecting section 42 on one end thereof. The other end of the extension 14 has a projection 52 which mates with one of the connecting sections 42. To accomplish this the underside of the projection 52 has flanges or projections 54 molded thereto which mate with the grooves 44 and an elongated slot 56 into which the screw receptor 48 can be accommodated. As with the base member, the extension 14 has upstanding flange members 58 which mate with the flange members 18 of the base member so that the strips 60 thereon will mate with the strips 20 so that the hook members 22 thereon will engage the loops on the underside of the strips 24 on the mop head.

Using the base member 16 as a starting point, mop lengths of the type shown in FIGS. 3–10 can be provided by adding the desired length extension or extensions 14 to the base frame 16. This is accomplished by sliding the extension towards the connecting section 42 with the flanges or projections 54 in the grooves 44 until the edges of the flanges 58 abut the flanges of the adjacent section and the slot 56 has its u-shaped bottom adjacent the screw receptor 48. The washer 38 is then placed over the extension 52 and the screw receptor 48 and the wing screw 62 is screwed into the screw receptor 48 to clamp the elements together. The strip 24 is then pressed against the strip 60 so that the loops on the underside of the strip 24 engage the hooks 22 o the strips 60.

As briefly discussed before, it is desired to provide a mop which can be expanded from 18" to 48" in width. It is preferred that such expansion or extensibility be in 6" increments as indicated in FIGS. 3–10 and the mop handle 40 be located in the center of each expanded width. Sequentially from FIG. 3 to FIG. 10 the widths are 18", 24", 30", 36", 42", 42" alternate, 48" and 48" alternate. The width dimension of the extension 14 for each of the FIGS. 3–10 is noted on each figure to show the various possibilities.

The herein disclosed expandable mop frame provides a basic construction which can be readily expanded with a minimum effort and which always has the mop handle located centrally of the expanded mop. It also allows the reduction of inventory of mops of various sizes since the expanded mop is comprised of one basic mop frame with components added for various sizes.

Although the preferred embodiment of the invention has been specifically described, it is contemplated that changes may be made without departing from the scope or spirit of the invention and it is desired that the invention be limited only by the scope of the claims.

I claim:

1. A dust mop comprising: an elongated mop frame, an upstanding flange along both edges of the elongated sides of said mop frame, means mounting a mop handle engaging member centrally of and parallel to the longitudinal direction of said mop frame, said mop handle engaging member having a first portion substantially in the midpoint of said mop frame and a second portion offset therefrom, said mop frame having means to support an extension thereto on both ends thereof, means connecting a mop frame extension to at least one of said mop frame support extension means, said mop frame extension having flanges on the edges thereof mating with the flanges on the mop frame, said mop frame and said mop frame extension having strips of material mounted on said flanges having upstanding hook members thereon and a mop head with a connecting strip on both sides thereof mounted on said mop frame and said mop frame extension with the connecting strip engaging said hook members.

2. The apparatus of claim 1 wherein said connecting strips have loops on the bottom thereof engaging said hooks.

3. The apparatus of claim 2 wherein said each of said second means has an internally threaded screw receptor therein, said mop frame extension having a slot therein overlying said screw receptor, said mop frame member being held to said extension by a washer and a screw inserted through said washer into said screw receptor holding said washer into engagement with said extension.

4. Apparatus to provide a frame for a mop head comprising: an elongated mop head frame: a first means on said frame for attachment of a mop thereto, a second means on both ends of said frame for ready attachment to an extension member for said mop frame and a third means located centrally of said frame for attachment to a mop handle, said third means including an elongated mop attachment rod mounted with its long dimension parallel to the long dimension of said elongated mop frame, said mop attachment rod being of sufficient length to accomodate the attachment of a mop handle in at least two positions depending on the length of an attachment to be attached to said second means.

5. The apparatus of claim 4 wherein said apparatus including an elongated mop frame member extension mated with one of said second means and held thereto.

6. The apparatus of claim 5 wherein each of second means has at least one groove therein extending in the elongated direction of said mop frame, said mop frame extension having a projection on the bottom thereof slidalby mounted in said groove.

7. The apparatus of claim 6 wherein each of said second means has an internally threaded screw receptor therein, said mop frame extension having a slot therein overlying said screw receptor, said mop frame member being held to said extension by a washer and a screw receptor holding said washer into engagement with said extension.

* * * * *